US005429319A

United States Patent [19]

Bogucki-Land et al.

[11] Patent Number: 5,429,319

[45] Date of Patent: Jul. 4, 1995

[54] COMPENSATING THREAD BRAKE

[75] Inventors: Bodgan Bogucki-Land, Offenbach/Main; Peter Schmuck, Obertshausen, both of Germany

[73] Assignee: Karl Mayer Textilmaschinenfabrik GmbH, Obertshausen, Germany

[21] Appl. No.: 101,970

[22] Filed: Aug. 4, 1993

[30] Foreign Application Priority Data

Aug. 6, 1992 [DE] Germany ..... 42 25 976.2

[51] Int. Cl.[6] ..... B65H 51/00; F16D 63/00; F16D 57/02

[52] U.S. Cl. ..... 242/419.9; 242/155 R; 242/47.01; 188/83; 188/296

[58] Field of Search ..... 242/155 R, 156.2, 419.8, 242/419.9, 47.01; 188/161, 78, 83, 296, 270, 290; 226/38, 44

[56] References Cited

U.S. PATENT DOCUMENTS

| | | | |
|---|---|---|---|
| 2,419,372 | 4/1947 | Schneider | 188/296 |
| 2,519,882 | 8/1950 | Bullard et al. | 242/419.9 X |
| 2,524,217 | 10/1950 | Ancet | 188/270 X |
| 2,574,378 | 11/1951 | Crookston | 242/155 R |
| 2,605,061 | 7/1952 | Howe | 188/290 X |
| 3,312,414 | 4/1967 | Knapp | 242/419.9 X |
| 3,349,553 | 10/1967 | Hood | 242/155 R |
| 3,499,615 | 3/1970 | Kircher | 242/155 R |
| 3,618,870 | 11/1971 | Martin | 242/156.2 X |
| 3,837,598 | 9/1974 | Brown | 242/155 R |
| 4,029,298 | 6/1977 | Lassche | 188/270 X |
| 4,660,783 | 4/1987 | Roser et al. | 242/155 R |
| 4,937,483 | 6/1990 | Matsui et al. | 188/161 X |

*Primary Examiner*—Daniel P. Stodola
*Assistant Examiner*—Michael R. Mansen
*Attorney, Agent, or Firm*—Omri M. Behr; Matthew J. McDonald

[57] ABSTRACT

A compensating thread brake useful, in particular, with warping creels. The thread brake has a rotatable roller whose circumference is at least partially surrounded by and drivable by thread. The roller is connected to the rotor of a turbine. A mechanical thread tension comparator by way of its setting member, influences a throttle in the path of the turbine inlet or outlet stream. The setting member may, preferably, be a throttle plate which regulates the inlet or outlet ports of turbine T. In this manner, the thread tension may be controlled without frictional load on the threads or the need to provide seals against oil or the like. Additionally, an eddy current brake can be provided for the nominal setting of the basic thread tension.

19 Claims, 2 Drawing Sheets

COMPENSATING THREAD BRAKE

BACKGROUND OF THE INVENTION

1. Field of the Invention

The present invention is directed to a compensating thread brake (and in particular to providing braking to warping creels) comprising a mechanical thread tension comparison means and a setting member coupled therewith, which influences the braking force operating upon the threads.

2. Description of Related Art

In a known compensating thread brake of this type (DE PS 30 35 765), the thread which is to be subject to the braking force is led through five pins, of which two are stationary and three are attached to a comparison lever. This device operates under the influence of (a) the thread tension, which influences a thread deflecting position, and (b) a "desired value" spring operating in a direction opposed to the deflecting direction, as well as (c) an eddy current damping arrangement.

When the thread tension is too great, the comparison lever swings in such a direction that the deflection angle and thus the braking force of the five pins is reduced. If the thread tension is too small, the comparison lever swings in the opposite direction, whereby the braking force is increased. The disadvantage of this arrangement is that during the braking step, the threads are exposed to friction. This is damaging for many materials due to mechanical and thermal factors.

In another compensating thread brake known in the art (DE OS 27 11 823), the travelling thread at least partially surrounds a roller and thus rotates it. The inside of this roller is provided with, suitably, a controllable braking arrangement. An oil filling and the air displacement of a cooling jet is utilized as the braking working fluid. The regulation is a result of the change in the oil surface layer in a narrow space, which is formed between a stationary and a rotating part and may be altered in dependence upon the loading. As a result thereof, there are considerable temperature increases in the oil. Furthermore, the sealing of the oil filling is problematic. Furthermore, the braking force depends not upon the thread tension, but rather upon the thread speed.

Accordingly, an object of the present invention is to provide an improved, compensating thread brake, which keeps the thread tension substantially constant without subjecting the threads to impermissible mechanical or thermal stress due to friction.

SUMMARY OF THE INVENTION

In accordance with the illustrative embodiments demonstrating features and advantages of the present invention, there is provided a compensating thread brake for a warping creel for affecting tension in thread delivered from a thread creel. The thread brake has a housing and a roller rotatably mounted on said housing. The roller is adapted to have at least partially wound around its circumference the thread. The roller is operable to rotate in response to motion of the thread. Also provided is a turbine and a comparison means. The turbine has a turbine axis and a rotor. The rotor is connected to the roller and can be driven by the roller to produce a turbine flow along a predetermined path. The comparison means can compare mechanical thread tension in thread delivered from the thread creels. Also provided is a setting member coupled to the comparison means for influencing the braking forces acting upon the thread at the roller. This setting member includes a throttle acting in the predetermined path of the turbine flow.

By employing such apparatus, a relatively efficient compensating brake is achieved. In a preferred embodiment a rotatable roller, at least partially wound with thread, is connected to the rotor of a turbine. This apparatus is defined as a turbine, although energy input is derived from the torque applied by the moving thread to the roller and the rotor to propel air. In some contexts the turbine might be defined as a compressor or fan. Preferably, thread tension is regulated by a throttle in the path of the turbine stream, adjusted with the assistance of a setting member, e.g. a setting lever with a thread eyelet.

In this mode of construction, the thread only comes into contact with the rotatable roller. Thus there is no thread stress resulting from friction. The braking by throttling the turbine stream, has the advantage of avoiding impermissible warming and the turbine air also acts as a coolant. Importantly, the throttle is formed with a setting member which, for its part, is coupled with the mechanism for comparing thread tension. In this way, the mechanical displacement of the throttle occurs directly from displacement of the mechanical thread tension comparison means resulting from a change in the thread tension. A further advantage is found wherein the danger of dirt contamination is very small. Dirt contamination by oil is impossible. Moreover, the continuous air stream ensures that no dirt particles can settle anywhere.

It is advantageous for the setting member to alter the cross-section of the input or output port of the turbine. Generally speaking, there is sufficient space there, to install such a setting member.

In a preferred embodiment, the turbine is provided with a central inlet port and the setting member is formed as a plate which is swingable about an axis parallel to the turbine axis. This gives rise to a very compact construction in which the thread tension comparator and the setting member are swingable in parallel planes, which considerably simplifies the mechanical combination of these paths.

In particular, it is desirable for the throttle plate to be rigidly connected with a comparison lever, which carries a thread deflector for determining thread tension. The plate lever and deflector may be biased by a predeterminable "desired value" force.

In a further embodiment, the direction of thread exiting the brake is through an exit eyelet. Also the turbine has a tangential outlet channel running parallel to the exiting thread. In this manner, the exiting air avoids adhesion of thread particles to creel elements.

It is further advantageous that the roller is also connected to a metal or metallic disk and that a magnetic system is provided at the edge of this disk. This operates as an alternating current or eddy current brake which supports the braking action of the turbine. This system gives rise, for example, to a basic thread tension of between 10 to 100 cN. The controllable turbine then only needs to compensate for the differences in the thread tension due to the decrease of the spool diameter.

In a preferred embodiment of the invention, the metal disk covers one side of the turbine rotor. This hardly requires any additional space.

It is particularly advantageous if the magnetic system is mounted at the edge of the disk with a radially adjustable component. In this manner, the basic tension of the thread can actually be set with respect to actual needs.

In a further embodiment a brake pad is activated after the stoppage of a downstream warp knitting machine and brings the roller to a standstill. Since the turbine only operates fully above a predetermined rate of rotation, the brake pad ensures that the thread does not loose tension when, during the stoppage of the warping machine, the roller rotates at low speeds.

The activation of the brake pad can take place as desired but it is particularly useful, however, to operate with pneumatic or electromagnetic means. This manner of control may be utilized at the same time for all thread brakes of a warping creel.

The best results are obtained when the thread travel at the roller up until standstill is no greater than that of the warping machine. This in any event, serves to avoid the overhang or snagging of neighboring threads.

BRIEF DESCRIPTION OF THE DRAWINGS

The invention may be described in further detail by reference to the accompanying drawings, wherein.

DETAILED DESCRIPTION OF THE PREFERRED EMBODIMENTS

Figure 1:
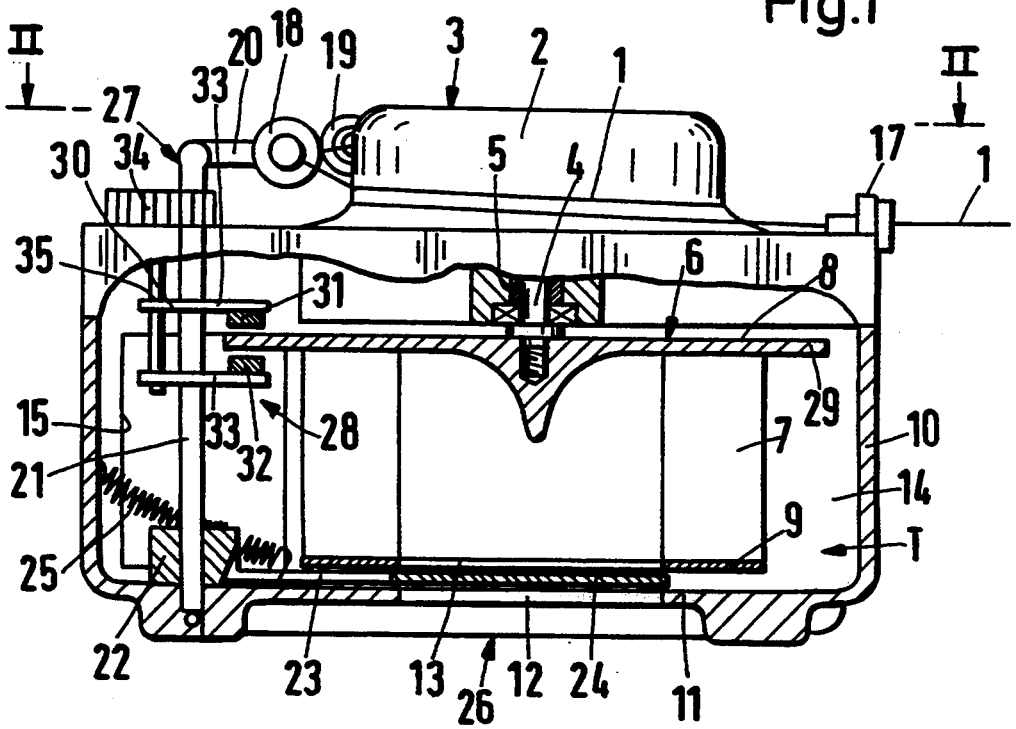
FIG. 1 is a side elevational view, partially on section, of a compensating thread brake according to principles of the present invention.
Figure 2:
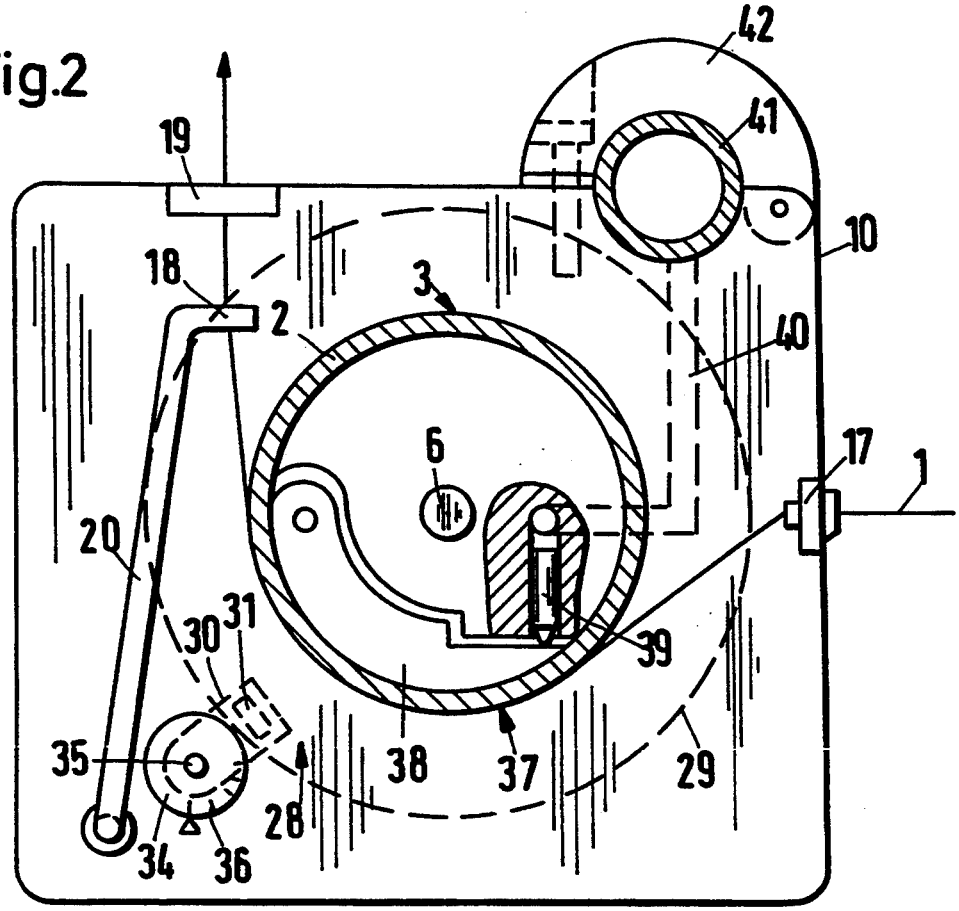
FIG. 2 is a plan view of the thread brake, sectioned along line II—II of FIG. 1 through the roller to reveal an auxiliary, hydraulically operated brake pad.

Referring to FIGS. 1 and 2, the thread 1 to be braked is laid partially around the cylindrical circumference 2 of a rotatable roller 3. Alternatively, one or more full terns of thread 1 can be wound around roller 1. Roller 3 can be a hollow cylindrical hub mounted on an axle 4 that is carried in a bearing 5 fixed in housing 10. Mounted on the inside end of axle 4 is rotor 6. Rotor 6 together with axle 4 rotates along the turbine axis of turbine T. The rotor 6 comprises a plurality of eight curved paddles 7, which are mutually connected at the top thereof to a metal disk 8 and at the bottom thereof with a face ring 9, both of which connect all paddles together.

The rotor 6 is mounted in a cup-shaped housing 10, which has an opening in its bottom 11 to form an inlet port 12 concentric with rotor 6 and coaxial with an inlet port 13 in the middle of face ring 9. A space 14 internal to housing 10 encircles rotor 6 and forms a tangential outlet channel input external to the rotor. The tangential outlet channel, whose cross-section diverges in a clockwise direction, communicates with the outlet port 15, which is located at the side face of housing 10. Space 14 may be formed as a molded body with a central cylindrical cavity communicating with the diverging tangential channel. Alternatively, this cavity and channel may be formed by internal walls within housing 10.

The thread 1 is taken off from spool 16 which is located in a creel (not shown) together with a large number of similarly arranged spools. The thread 1 runs through inlet eyelet 17 (mounted atop housing 10), loops at least partially around roller 3 (but preferably several times), passes through a thread deflector 18 (also in the form of an eyelet), and finally is pulled through exit eyelet 19 by a drive arrangement (not shown), which may be a drive roller or a warping beam. The thread exit direction corresponds with the output direction of air exiting from output port 15, so that no small thread particles can attach themselves to the creel elements.

The thread deflector 18 is attached to a comparison lever 20 which is rigidly affixed to a rotating setting axle 21 which is journalled in housing 10 and runs parallel to the axis of the turbine T. Clamped at the lower end of rotating axle 21 is block 22, which carries a further lever 23, carrying circular throttle plate 24 serving as a setting member. Lever 23 is biased to move plate 24 away from the closed throttle position of FIG. 2 by tension spring 25, which is stretched between the inside of housing 10 and lever 23 Plate 24 is reciprocatable between inlet port 12 of housing 10 and inlet port 13 in ring 9 of rotor 6. Plate 24 together with these inlet ports, form a throttle 26 in the path of the turbine stream.

Thread comparison means 27 comprises the comparison lever 20, in conjunction with the thread deflector 18 and lever 23 connected thereto via axle 21, to which is attached tension spring 25.

Figure 3:
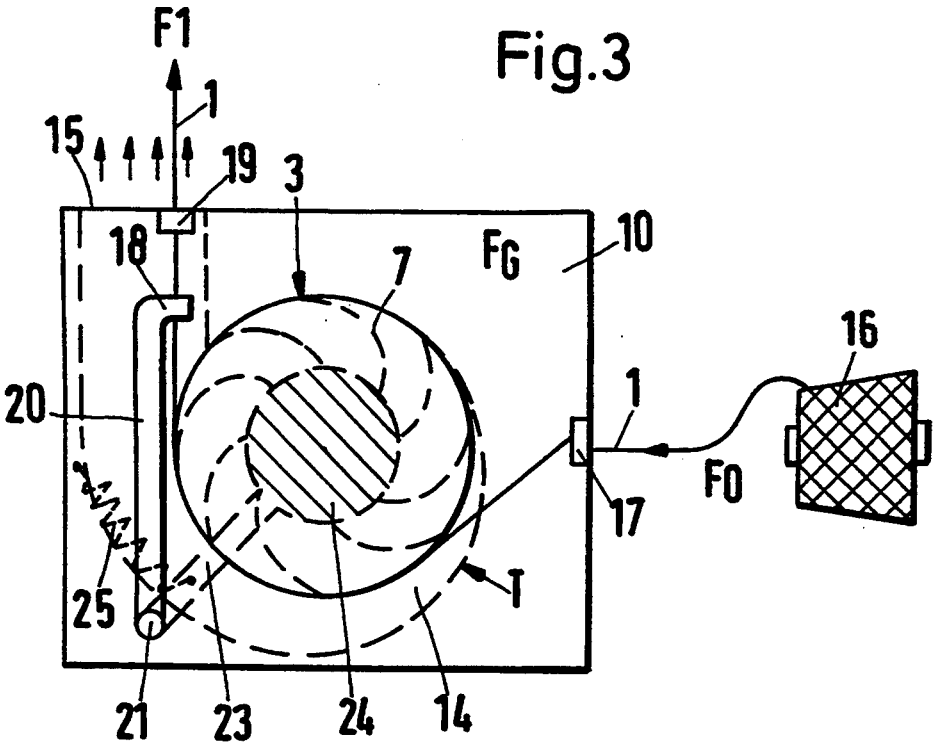
FIG. 3 is a schematic plan view of the thread brake of FIG. 2, but shown operating with a strongly tensioned thread.
Figure 4:
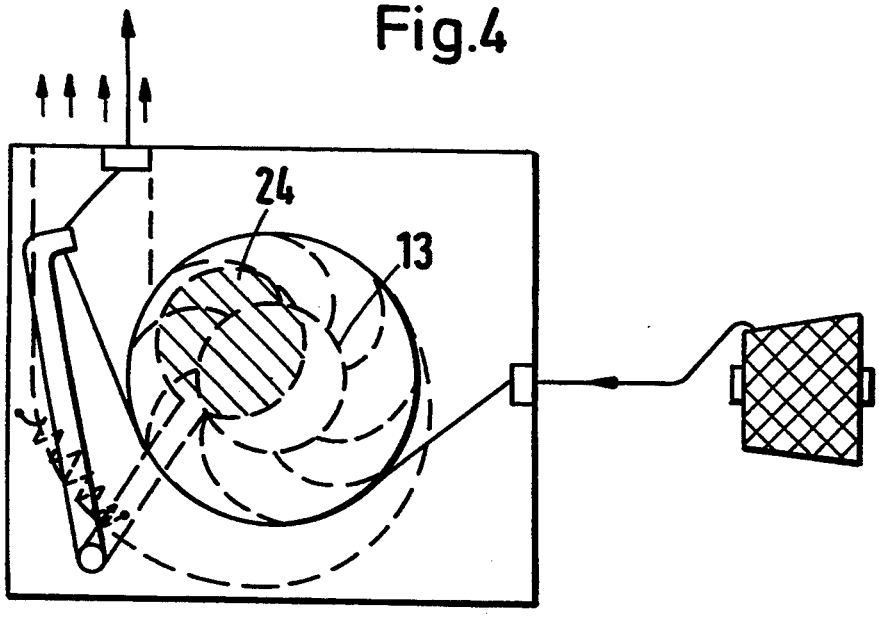
FIG. 4 is a plan view similar to FIG. 2, operating with a weakly tensioned thread.

FIG. 2 shows an example of thread 1 under higher tension and thus the comparison lever 20 is pulled to turn clockwise (into its rightmost position). In the illustrated position, plate 24 moves between inlet ports 12 and 13 and substantially closes them. Since a very small amount of air flows into the turbine, the braking power is reduced and with it the thread tension. When, in contrast, thread tension is reduced and the comparison lever 20 moves into the position shown in FIG. 3 under the influence of spring 25, a substantial part of the port 12 is freed from plate 24. Thus, there is a higher rate of air flow through the turbine T. The braking action increases and the thread tension again increases until an equilibrium position is reached. This equilibrium position can be set by displacement of spring 25 as desired.

The diameter of the roller 3 is chosen to provide a high rate of rotation suitable for braking. For example, for a thread take-off of 1,000 meters per minute, a rotation of 6,000 revolutions per minute should be reached. The outgoing tension $F_1$ is obtained from an incoming tension $F_0$ supplemented by a turbine generated tension of $F_g$ in accordance with the equation $F_1=F_0+F_g$. The outgoing tension $F_1$ should be constant. The incoming tension $F_0$ in practice increases with decreasing diameter of spool 16. The additional tension $F_g$ provided by the turbine, must therefore be reduced over time. This reduction corresponds to a lower degree of braking. The corresponding reduction of the free inlet cross-sectional area of throttle 26, that is to say, the area of the input and output ports 12 and 13 not covered by plate 24, is permitted until this condition is satisfied over the entire work area.

When the incoming tension $F_0$ increases with the decreasing diameter of spool 16, comparison lever 20 tends to be pulled more strongly toward roller 3 and the inlet port 12 and 13 are more completely covered. This reduces the additional force $F_g$.

Furthermore, an eddy current brake 28 is foreseen. This comprises a magnetic braking system 30 on the protruding edge 29 of metal disk 8. In FIG. 1, the position of the magnet system 30 is shown displaced in the circumferential direction in order to more clearly recognize the individual items. The magnet system 30 comprises permanent magnets 31 and 32, which straddle edge 29 between them. Magnets 31 and 32 are separately attached to a pair of swinging arms 33 which are angularly adjustable about axle 35, by means of a setting knob 34. The magnetic field can therefore be displaced with radial components relative to the disk edge 29 which permits the braking action to be altered. The desired setting can be reproduced by the aid of a scale 36 on setting knob 34. Alternatively, a simple friction brake or clutch can be mounted to engage disk 29 or other moving components associated with turbine T.

The magnet brake 28 thus provides the basic thread tension while the control turbine brake compensates for thread tension variations.

When the warp machine is attached and running, the thread speed may fall for various reasons. With reduced thread speed, the turbine and the eddy current brake may no longer exercise braking power. For this reason, a further brake 37 is contemplated having a brake shoe 38 pivotally mounted in housing 10, which shoe can be urged against the inside of circumferential wall 2 of roller 3. For this purpose, reservoir 39, via line 40, can be supplied with air pressure. The line 40 is fed by distribution line 41, which is attached to housing 10 by means of clamp 42. When air pressure is supplied via this distribution pipe, all of the brakes which serve the warping machine can be mechanically braked.

Many variations of the above-identified embodiments are possible without departing from the basic idea of the invention. For example, throttle 26 can also be provided to the outlet port 15 of the turbine. In place of a tensioned spring 25, there may be utilized a compression spring or other suitable methods for the pretensioning of the thread tension comparison means. The throttle can also be provided on a circumferential wall of the rotor.

We claim:

1. A compensating thread brake for a warping creel for affecting tension in thread delivered from a thread creel, comprising:

a housing;

a roller rotatably mounted on said housing and adapted to have at least partially wound around its circumference said thread, said roller being operable to rotate in response to motion of said thread;

a turbine having a turbine axis and a rotor connected in a torque transferring relation to said roller to produce a turbine flow along a predetermined path and to affect braking forces acting upon the thread on said roller, said turbine having at least one port along said predetermined path;

comparison means for detecting mechanical thread tension in thread delivered from said thread creels; and a setting member coupled to said comparison means for influencing the braking forces acting upon the thread at said roller, said setting member comprising a throttle acting in said predetermined path of said turbine flow to throttle said turbine flow, said member being operable to alter the effective cross-sectional area of said at least one port of the turbine.

2. A compensating thread brake in accordance with claim 1 wherein said at least one port of the turbine along said predetermined path includes an inlet and outlet port, said setting member being operable to alter the effective cross-sectional area of one of said inlet or outlet ports of the turbine.

3. A compensating thread brake in accordance with claim 2 wherein said setting member has a plate mounted to rotate about a setting axis parallel to the turbine axis to cover by a variable amount one of said inlet or outlet ports of the turbine.

4. A compensating thread brake in accordance with claim 3, wherein said comparison means comprises:

a comparison lever rigidly connected to said plate for rotating said plate to cover by a variable amount one of said inlet or outlet ports of the turbine; and a thread deflector coupled to said comparison lever for (as) deflecting said thread, sensing tension in said thread and (c) moving said comparison lever in response to tension in said thread, said thread deflector being biased by a predetermined value.

5. A compensating thread brake in accordance with claim 4, comprising:

an exit eyelet for setting an exit direction for the thread exiting said brake, said turbine having a tangential outlet channel feeding said outlet port in a direction parallel to the exit direction of the thread.

6. A compensating thread brake in accordance with claim 4 wherein the roller comprises a metallic disk, said compensating thread brake further comprising:

a magnetic braking system being edge mounted at said metallic disk.

7. A compensating thread brake in accordance with claim 6 wherein said metallic disk coaxially abuts the rotor of said turbine.

8. A compensating thread brake in accordance with claim 7 wherein the magnet braking system is radially adjustable with respect to the edge of said metallic disk.

9. A compensating thread brake in accordance to claim 4 wherein said warping creel feeds a warp knitting machine, said compensating thread brake comprising:

a brake pad for activation during stopping of the warp knitting machine and having means for bringing said roller to a standstill.

10. A compensating thread brake in accordance with claim 2 wherein the roller comprises a metallic disk, said compensating thread brake further comprising:

a magnetic braking system being edge mounted at said metallic disk.

11. A compensating thread brake in accordance to claim 2 wherein said warping creel feeds a warp knitting machine, said compensating thread brake comprising:

a brake pad for activation during stopping of the warp knitting machine and having means for bringing said roller to a standstill.

12. A compensating thread brake in accordance with claim 1 wherein the roller comprises a metallic disk, said compensating thread brake further comprising:

a magnetic braking system being edge mounted at said metallic disk.

13. A compensating thread brake in accordance with claim 12 wherein the magnet braking system is radially adjustable with respect to the edge of said metallic disk.

14. A compensating thread brake in accordance to claim 12 wherein said warping creel feeds a warp knitting machine, said compensating thread brake comprising:

a brake pad for activation during stopping of the warp knitting machine and having means for bringing said roller to a standstill.

15. A compensating thread brake in accordance with claim 14 wherein the activation of said brake pad is operable electromagnetically.

16. A compensating thread brake in accordance with claim 14 wherein the activation of said brake pad is operable pneumatically.

17. A compensating thread brake in accordance with claim 1 comprising:

an exit eyelet for setting an exit direction for the thread exiting said brake, said turbine having a tangential outlet channel directed parallel to the exit direction of the thread.

18. A compensating thread brake in accordance to claim 1 wherein said warping creel feeds a warp knitting machine, said compensating thread brake comprising:

a brake pad for activation during stopping of the warp knitting machine and having means for bringing said roller to a standstill.

19. A compensating thread brake in accordance with claim 1 wherein said warping creel feeds a warp knitting machine, said compensating thread brake comprising:

a brake pad for activation during stopping of the warp knitting machine up until standstill, said brake pad having means for keeping thread travel at said roller no greater than that at said warp knitting machine.

* * * * *